United States Patent [19]

Steinbach

[11] Patent Number: 4,735,069

[45] Date of Patent: Apr. 5, 1988

[54] CYLINDER LOCK AND KEY

[75] Inventor: Robert L. Steinbach, Glendale Heights, Ill.

[73] Assignee: Chicago Lock Co., Chicago, Ill.

[21] Appl. No.: 685,595

[22] Filed: Dec. 24, 1984

Related U.S. Application Data

[63] Continuation of Ser. No. 360,886, Mar. 23, 1982, abandoned, which is a continuation-in-part of Ser. No. 283,226, Jul. 14, 1981, Pat. No. 4,446,709.

[51] Int. Cl.[4] ..... E05B 19/06; E05B 27/08

[52] U.S. Cl. ..... 70/363; 70/409; 70/420; 76/110; 264/23; 264/248

[58] Field of Search ..... 70/363, 395, 408, 409, 70/389, 390, 420, 419, 421; 76/110, 101 R; 29/417, 510; 264/249, 23, 248; 72/709

[56] References Cited

U.S. PATENT DOCUMENTS

| | | | |
|---|---|---|---|
| 180,255 | 7/1876 | Miller | 70/363 |
| 209,815 | 11/1878 | Keil . | |
| 419,091 | 1/1890 | Williams | 70/363 |
| 450,745 | 4/1891 | Lincoln . | |
| 919,259 | 4/1909 | Simpson . | |
| 1,088,917 | 3/1914 | Meledonian | 70/363 |
| 1,141,215 | 6/1915 | Sohm | 70/363 |
| 1,819,853 | 8/1931 | Von Mehren | 70/383 |
| 1,899,739 | 2/1933 | Von Mehren | 70/395 |
| 2,036,738 | 4/1936 | Zygmunt | 70/363 |
| 2,036,747 | 4/1936 | FitzGerald . | |
| 2,391,834 | 12/1945 | Johnstone | 70/363 |
| 2,687,638 | 8/1954 | Abernathy | 70/363 |
| 2,772,557 | 12/1956 | Audicio | 70/363 |

(List continued on next page.)

FOREIGN PATENT DOCUMENTS

| | | | |
|---|---|---|---|
| 542879 | 7/1957 | Canada | 70/421 |
| 835058 | 2/1970 | Canada | 70/363 |
| 981047 | 1/1976 | Canada | 70/363 |
| 2239402 | 3/1973 | Fed. Rep. of Germany | 70/363 |
| 540068 | 4/1922 | France | 70/363 |
| 675162 | 10/1929 | France | 70/363 |
| 770817 | 9/1934 | France | 70/363 |
| 2270420 | 12/1975 | France | 70/363 |
| 2278882 | 2/1976 | France | 70/395 |
| 2450928 | 11/1980 | France | 70/363 |
| 416459 | 11/1946 | Italy | 70/363 |
| 472675 | 2/1966 | Italy | 70/408 |
| WO83/03439 | 10/1983 | PCT Int'l Appl. | 76/110 |
| 277918 | 11/1947 | Switzerland | 70/363 |
| 278505 | 2/1952 | Switzerland | 70/363 |
| 577686 | 5/1946 | United Kingdom | 70/408 |
| 614387 | 12/1948 | United Kingdom | 70/363 |
| 639024 | 6/1950 | United Kingdom | 70/363 |
| 1512628 | 6/1978 | United Kingdom | 76/110 |

*Primary Examiner*—Lloyd A. Gall
*Attorney, Agent, or Firm*—Gerlach & O'Brien

[57] ABSTRACT

A key is an assembly of a thermoplastic handle and a blade, which are formed separately from each other. The blade is substantially flat, and includes on each of its opposite sides a plurality of parallel longitudinal lands having forwardly-facing bittings thereon, and a plurality of parallel longitudinal grooves which alternate with the lands and space them apart. The bittings serve to engage transverse rows of axially reciprocatable tumblers in a cylinder lock, and the grooves receive lock wards therein, while the distal end of the blade engages the lock to determine the depth of insertion of the key blade. The blade also is provided with a capture pin opening, and with a proximal end structure which cooperates with the handle in assembling the key. The blade is made from a length of bar stock which is rolled in order to form lands and grooves on the sides of a flat strip. The lands preferably project laterally outwardly for different distances, to provide increased security and to increase the number of possible key changes. Thereafter, the bar is stamped to form openings and recesses, and cut into individual key blade blanks. Forwardly facing bittings are provided in the lands of each blank, by milling from a distal end of the blade. The proximal end of the blade is inserted into a pocket formed in the handle and secured by the application of ultrasonic wave energy.

7 Claims, 3 Drawing Sheets

U.S. PATENT DOCUMENTS

| | | | |
|---|---|---|---|
| 2,855,810 | 10/1958 | Brunner | 76/110 |
| 3,267,706 | 8/1966 | Kerr | 70/363 |
| 3,418,833 | 12/1968 | Kerr | 70/389 |
| 3,509,748 | 5/1970 | Trainor . | |
| 3,604,231 | 9/1971 | Buschi . | |
| 3,729,965 | 5/1973 | Gartner . | |
| 3,733,863 | 5/1973 | Toepfer . | |
| 3,786,659 | 1/1974 | Elder et al. | 70/395 |
| 3,813,906 | 6/1974 | Kerr . | |
| 3,945,229 | 3/1976 | Frank | 70/363 |
| 4,012,931 | 3/1977 | Harunari . | |
| 4,046,181 | 9/1977 | Barnsdale | 411/180 |
| 4,069,696 | 1/1978 | Steinbach . | |
| 4,104,897 | 8/1978 | Freedman | 70/363 |
| 4,203,693 | 5/1980 | Schwartz et al. | 51/100 R X |
| 4,325,242 | 4/1982 | Tietz | 70/409 X |
| 4,446,709 | 5/1984 | Steinbach | 70/424 X |

CYLINDER LOCK AND KEY

CROSS-REFERENCE TO RELATED APPLICATION

This is a continuation of my co-pending application Ser. No. 360,886, filed Mar. 13, 1982, now abandoned, which is a continuation-inpart of my co-pending U.S. patent application Ser. No. 283,226, filed July 14, 1981, now U.S. Pat. No. 4,416,709.

BACKGROUND OF THE INVENTION

This invention relates to an improvement in keys, especially those which are used with axial pin tumbler locks. More particularly patent application, and to the manufacture thereof.

Many axial pin tumbler locks have a cylinder within which tumblers are slidable in a direction parallel to the axis of the cylinder. In a large proportion of such locks, the tumblers are arranged in a circular pattern, thus requiring a cylindrically shaped, so-called circular key to operate them. In the axial pin tumbler lock disclosed in the above referenced patent application, however, the tumblers are arranged in at least one planar row, so that they are operable by bittings located on a flat-bladed key.

Flat-bladed keys in general are known to the prior art. Some of them have longitudinally facing bittings adapted to cooperate with one or more rows of axially movable pin tumblers, as disclosed in U.S. Pat. Nos. 3,733,963 of Toepfer, 3,604,231 of Buschi, 2,036,747 of FitzGerald, 919,259 of Simpson, 219,815 of Keil, and 180,255 of Miller. 3,813,906 of Kerr and 450,745 of Lincoln are also somewhat relevant in this connection. But none of these keys is so designed as to take the fullest advantage of the flat blade configuration to provide maximum security, a great number of key changes, and minimal expense and difficulty of manufacturing commercially. Moreover, a number of the prior keys are readily duplicated, and the number of possible key changes provided by various key designs and lock and key combinations is relatively limited. Also, the bitting arrangement of certain of the keys is such that the bittings may engage or "pick up" tumblers other than those intended.

Prior art methods of manufacturing grooved keys have involved grinding grooves in key blades. In U.S. Pat. No. 3,729,965 of Gartner, it is recognized that manufacturing keys by grinding grooves in individual blades is expensive, and that a less costly approach is to extrude an elongated piece of blade stock with the desired grooves, thereafter cutting it to individual blade lengths. The key handles are manufactured separately, and attached to the individual blades afterwards.

SUMMARY OF THE INVENTION

The present invention provides a key for a lock such as disclosed in my above-identified application, more particularly, a lock having a longitudinally extending diametral keyway and a planar transverse row of tumblers longitudinally reciprocatable in the lock with a side portion of each tumbler projecting into the keyway and an outer end of such portion being accessible for engagement with the key, such lock also having at least one ward projecting transversely into the keyway. The new key of the invention includes a blade having a distal end adapted for abutting engagement with the lock to limit insertion of the key into the lock, a bitting for each of the tumblers and comprising a transverse shoulder on the blade disposed at the inner end of a recess extending longitudinally in the blade from the distal end thereof and receiving the side portion of the tumbler therein for abutting engagement of the bitting with the outer end of the side portion, and means providing at least one groove extending longitudinally in the blade from its distal end and receiving the ward therein for insertion of the key into the lock unlimited by any engagement of a ward with the key. The invention includes the new key and the combination of the key and the lock.

In its preferred embodiments, the key includes at least one bitting which projects laterally outwardly on the blade for a greater distance than at least one other bitting. The bittings preferably are formed on longitudinal lands on at least one side of the blade, and the lands alternate with longitudinal grooves in such side.

The new key cooperates with a lock having multiple tumblers, e.g., as many as eight pin tumblers, and also having protective wards, to provide a high degree of security, which is further enhanced by the preferred provision of disparately-sized bittings and lands on which the bittings are provided. The structure at the same time provides for a great number of key changes.

Another feature of the invention which contributes to security in general is that the key may be reproduced by others only by a time-consuming and expensive procedure, and then, with difficulty in achieving the precision that is necessary in providing grooves, projections, and spacings.

The land-and-groove structure of the key both contributes to security and serves to space bittings apart, so that there is no problem of bittings undesirably engaging tumblers adjacent to the tumblers which the bittings are intended to engage. The structure further cooperates with the lock to minimize key play and provide accuracy in operation.

The key may be manufactured commercially in a relatively simple and economical manner method. Thus, key blades may be manufactured conveniently and rapidly from bar stock of a desirable alloy or other suitable material, by successive rolling, stamping, and milling operations, which produce strong, accurately made blades, with little waste of material. The blades are readily assembled with handles, which preferably are constructed of thermoplastic material and are joined to the blades by heating, in a simple, rapid, and economical procedure. As compared to keys made by prior art methods, the key blade is stronger and the blade and handle assembly is more durable when made in accordance with the present invention.

These and other features, objects and advantages of the invention will be more fully appreciated from the following detailed description, taken in conjunction with the accompanying drawings.

THE DRAWINGS

The drawings represent a preferred embodiment of the invention. The embodiment is merely illustrative, and the invention is not limited thereto.

Like elements are identified by like reference characters in each of the views of the drawings, wherein.

DETAILED DESCRIPTION OF THE PREFERRED EMBODIMENT

Figure 1:
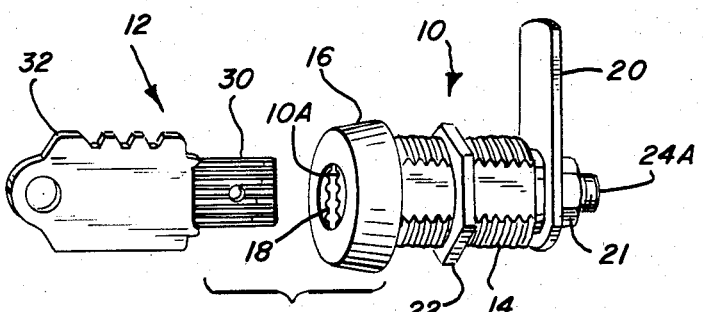
FIG. 1 is a perspective view of a key constructed in accordance with this invention, together with the lock for which it is adapted.

FIG. 1 shows the lock 10 of the co-pending patent application identified above, having a keyway 10A, and a key 12 according to this invention which is designed to operate a lock of that type. The lock includes a tubular barrel 14, at one end of which is a closure cap 16 and a facing plate 18. At the opposite end of the barrel 14 is a locking arm 20. A mounting nut 22 is threaded to the tubular barrel 14 for the purpose of securing the lock 10 to some type of enclosure (not shown). The locking arm 20 is secured to a threaded extension 24a of a lock cylinder 24 (FIGS. 8–11) by a nut 21, and projects at an angle from the lock to prevent the door of the enclosure from being opened. In order to unlock the door, it is necessary to turn the lock cylinder 24, which is rotatable within the tubular barrel 14. This cylinder 24 cannot be turned, however, unless a number of pin tumblers 26 (FIGS. 9, 10 and 16) are moved precisely the correct distances in a direction parallel to the common longitudinal axis of the tubular barrel 14 and of the lock cylinder 24. This is the function which is performed by the key 12 of the invention, by insertion into the keyway 10A.

Figure 6:
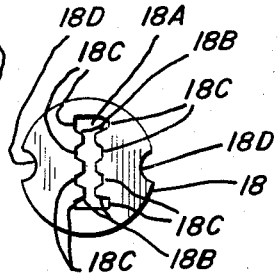
FIG. 6 is a front elevational view of a facing plate in the lock of FIG. 1.
Figure 7:
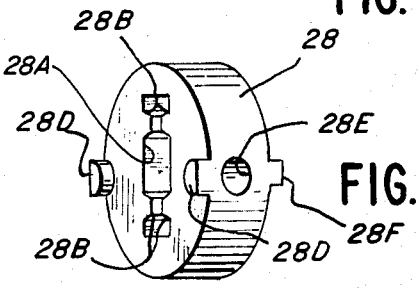
FIG. 7 is a further enlarged front and side perspective view of a spacer in the lock.

In order to admit the key 12 to the interior of the lock 10, the generally circular facing plate 18 is provided with an elongated key-receiving opening 18A. The key-receiving opening 18A constitutes an outermost or first portion of the longitudinally extending, diametral or transverse keyway 10A. On both sides of this opening 18A, a plurality of wards 18B project inwardly into the opening, and they define grooves 18C alternating with them, as best seen in FIG. 6.

FIGS. 7 and 9–11 illustrate a cylindrically-shaped spacer 28, which is located directly behind the facing plate 18. This spacer is provided with an elongate longitudinal key-receiving opening 28A, which is aligned or registers with the key-receiving opening 18A of the facing plate 18, and constitutes an intermediate or second portion of the keyway 10A. Wards 28B extend into the key-receiving opening 28A of the spacer and are aligned with certain wards 18B in the facing plate. The width of the spacer opening 28A is equal to the greatest width of the opening 18A in the facing plate 18 in any of the alternative configurations of the opening, described hereinafter.

The spacer 28 also has two arcuate front lugs 28D and two rectangular rear lugs 28F on respective front and rear faces thereof. The facing plate 18 has two arcuate recesses 18D in its periphery, which recesses are adapted to receive the front lugs 28D of the spacer 28, for the purpose of preventing relative rotation between the facing plate and the spacer.

Figure 9:
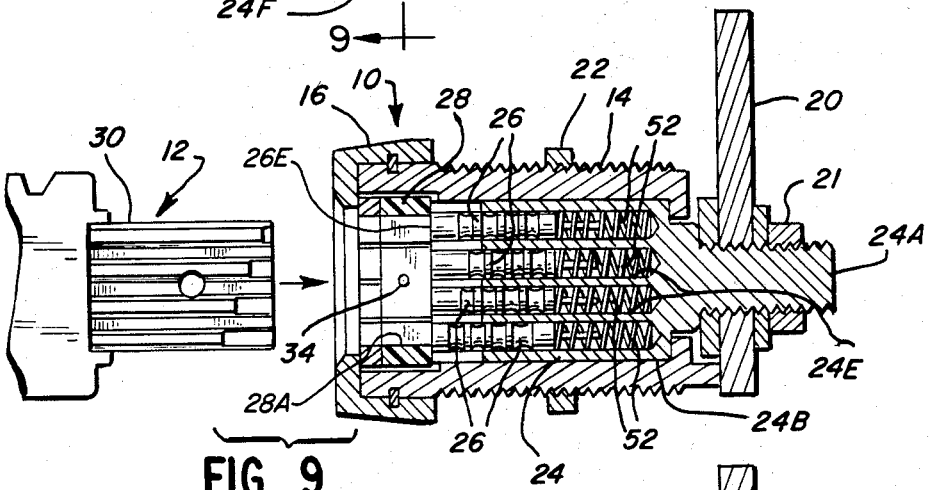
FIG. 9 is a longitudinal sectional view of the lock, taken substantially on line 9—9 of FIG. 8, together with a fragmentary side elevational view of the key in position to be inserted into the lock.
Figure 10:
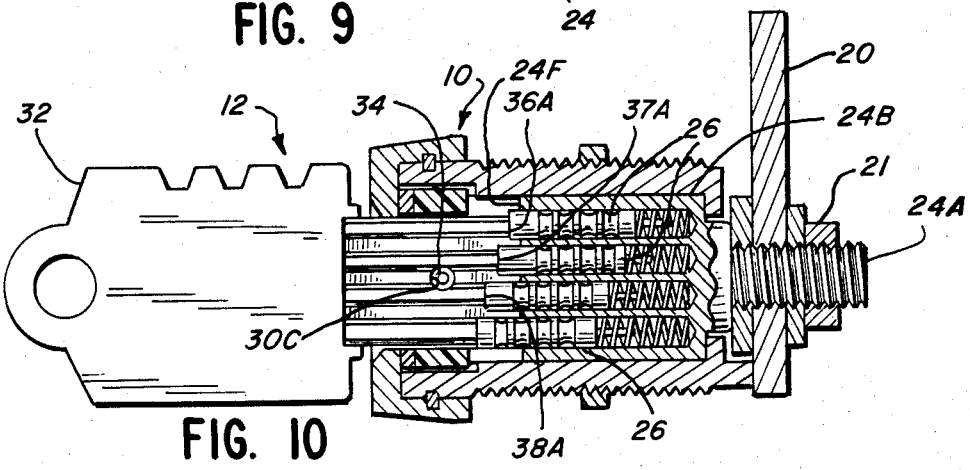
FIG. 10 is a view similar in all respects to FIG. 9 except that the key is inserted into the lock.
Figure 11:
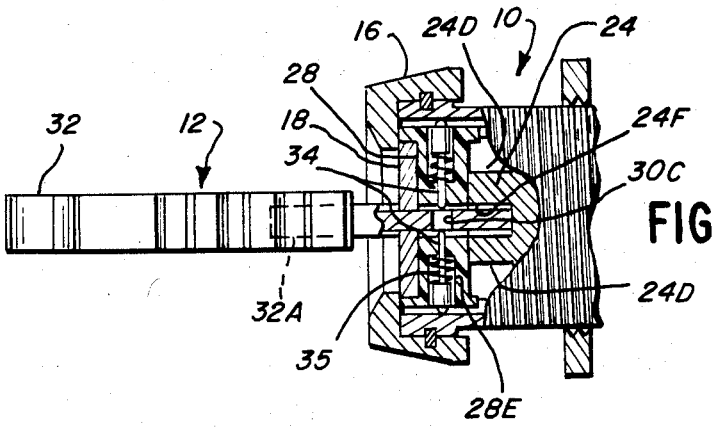
FIG. 11 is a top plan view of the lock and key, in the same positions as in FIG. 10, with parts broken away and sectioned for clarity of illustration.

The spacer 28 is provided with two diametrically opposed, counterbored, radial, pin-receiving openings 28E, which extend from its outer periphery to its key-receiving opening 28A. As illustrated in FIGS. 9—11, a capture or retention pin 34 of similar configuration is mounted in the spacer 28 for reciprocal radial movement in each opening 28E, under the outward bias of a capture pin spring 35.

Referring to FIGS. 8–11, the lock cylinder 24 includes a cylindrical body 24B having a front face 24C, which body rotates within the barrel 14 and is integral with the extension 24A. Two longitudinal grooves 24D (FIG. 11) are provided in the surface of the lock cylinder 24, and they extend rearwardly from the front face 24C in diametrically spaced-apart parallel relation. The grooves 24D receive respective rear lugs 28F of the spacer 28, to prevent relative rotation between the spacer and the cylinder. Thus, owing to the engagement of the spacer front and rear lugs 28D and 28F with the facing plate 18 and the lock cylinder 24, respectively, the facing plate, the spacer, and the cylinder are interconnected for rotating as a unit in the barrel 14.

The lock cylinder 24 is provided with two spaced-apart parallel planar transverse rows of spaced-apart cylindrical blind tumbler bores 24E extending from the front face 24C in parallel relation in the direction of the longitudinal axis of the cylinder. A coil compression tumbler spring 52 and a tumbler 26 are received in each of the bores 24E, for reciprocal longitudinal movement of the tumbler therein.

A diametral key-receiving slot 24F (FIGS. 8 and 11) extends rearwardly in the axial direction from the front face 24C of the lock cylinder 24 for a minor portion of the length of the cylinder body 24B. The slot 24F is aligned or registers with the key-receiving openings 18A and 28A in the facing plate 18 and the spacer 28, respectively, and the slot 24F constitutes an innermost or third portion of the keyway 10A. The slot 24F intersects the walls of the tumbler bores 24E, whereby an angularly minor section of the wall of each bore is removed, on the inside of its row of bores. A corresponding section of each tumbler 26 is exposed in the slot 24F (see FIG. 8).

Figure 16:
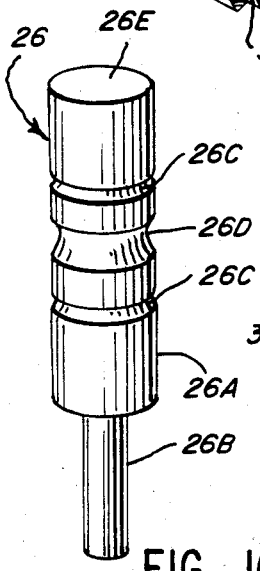
FIG. 16 is an enlarged perspective view of a tumbler in the lock.

Referring to FIG. 16, each tumbler 26 includes a cylindrically shaped body 26A and a cylindrical stem 26B of reduced diameter extending axially from a rear end of the body. The body 26A is provided with one or more shallow peripheral grooves 26C, and a relatively deep peripheral groove 26D, for operating purposes, as described in the above-identified application. Briefly, the shallow grooves 26C constitute false picking grooves, while the deep groove 26D constitutes an unlocking groove. As illustrated in FIG. 9, the tumbler stems 26B are received in the springs 52 and the tumbler bodies 26A are seated on the springs, so that the tumblers are urged outwardly, with their outer or front ends 26E in abutting engagement with the spacer 28 in the locking condition of the lock 10.

Figure 8:
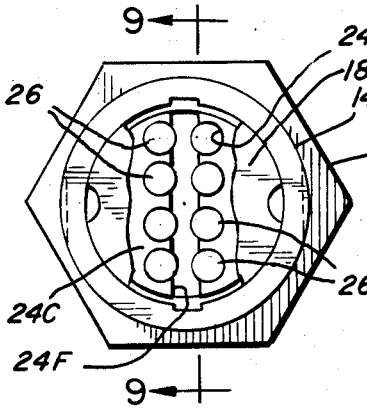
FIG. 8 is a similarly enlarged front elevational view of the lock, with a cap thereof removed and parts broken away to reveal internal structure.

As seen in FIG. 8, an angularly minor side portion or section of each tumbler body 26A projects transversely into the portion of the keyway 10A formed by the cylinder slot 24F. The outer end of such tumbler body portion, being a part of the tumbler outer end 26E, is accessible for engagement with a blade 30 of the key 12. The wards 18B of the facing plate 18 and the wards 28B of the spacer 28 also project transversely into the keyway 10A, and, in general, they are disposed in common longitudinal planes with the portions of the cylinder body 24B which exist between the tumbler bores 24E.

Figure 2:
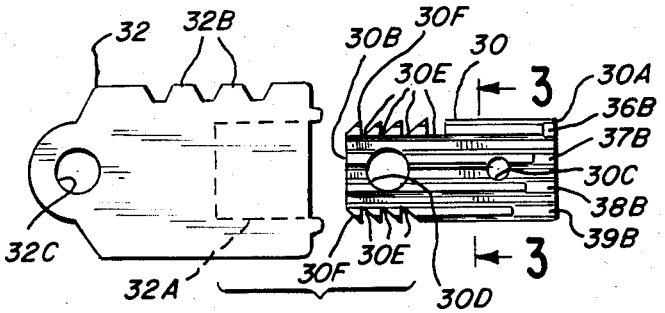
FIG. 2 is an enlarged exploded side elevational view of the key.

In accordance with this invention, the key 12 is assembled from two separate components, a metal blade 30 or shank and a plastic handle 32 (FIG. 2). The blade has a distal or operating end 30A and a proximal end 30B. The handle is formed with a pocket 32A, best seen in FIGS. 2 and 11, which is adapted to receive the proximal end 30B of the blade. The handle is provided with serrations 32B along one edge only, so that the user can determine by feel the manner in which to orient the key for insertion into the keyway 10A of the lock 10. The handle 32 also is provided with a keychain hole 32C.

Figure 3:
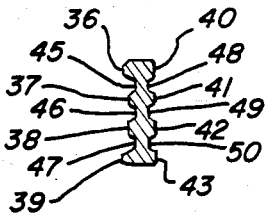
FIG. 3 is a cross-sectional view of the key blade, taken on the line 3—3 of FIG. 2.
Figure 4:
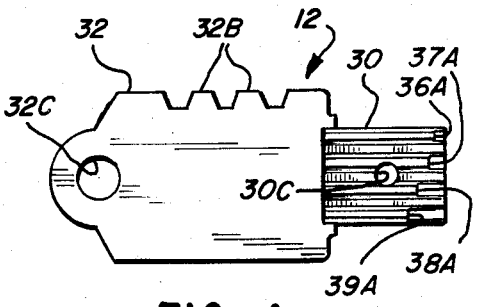
FIG. 4 is a side elevational view of the key.

The key 12 is what is known as a "flat" key, having a generally flat blade 30, as distinguished from a "round" or "circular" key, having a generally circular tubular shank. Referring to FIG. 3, the blade 30 is provided with a plurality of parallel longitudinal alternating lands and grooves on each of its sides, there being four lands 36–39 interspersed with three grooves 45–47 on one side, and four lands 40–43 interspersed with three grooves 48–50 on the opposite side. In the illustrative preferred embodiment, the locations of the lands and grooves on the opposite sides are alike, so that they are arranged in back-to-back relation on the blade. Two of the lands on one side of the embodiment, numbered 36 and 39, project laterally outwardly from the blade body for greater distances than or beyond the remaining lands 37 and 38, i.e., are enlarged with respect to the remaining lands.

Referring to FIGS. 2, 4, 5 and 15, the several lands 36–43 have respective forwardly-facing bittings 36A–43A thereon. The bittings comprise transverse shoulders on the lands 36–43, disposed at the inner ends of recesses, such as those numbered 36B–39B in FIGS. 2 and 15, which extend longitudinally in the lands from the distal end 30A of the blade 30, for various selected distances corresponding to the lock tumbler code. The recesses 36B-39B, and corresponding recesses on the opposite side of the blade, have the shape of a section of a cylinder, for receiving therein the above-described tumbler body side portions which project into the keyway 10A, with the outer ends of the side portions, at 26E, abuttingly engaging respective bittings 36A–43A. Various key changes are achieved by different combinations of bitting locations on the lands 36–43.

In the preferred embodiments of the invention, the number of key changes is increased by arranging for one or more of the lands of the key blade 30 to be enlarged with respect to (i.e., more prominent than) the others. Thus, for example, the top and bottom lands 36 and 39 in the illustrative embodiment are enlarged with respect to the other lands (see FIGS. 3 and 5). The elongate opening 18A in the facing plate 18 is designed to accommodate the enlarged key blade lands 36 and 39, with corresponding grooves 18C which are deeper than the grooves 18C at the locations which accommodate the remaining lands of the key blade. Such a facing plate can only accommodate a key blade which does not have an enlarged land in any position where a relatively shallow groove 18C appears in the facing plate opening 18A. Thus, in order to open the lock 10, the key blade 30 must have a land configuration which is not excluded from entering the cylinder 24 by the groove configuration of the facing plate 18, in addition to having a bitting configuration which matches the code for the tumblers 26, i.e., the locations of the unlocking grooves 26D, as described in the above-identified application.

Since the facing plate 18 is external to the spacer 28 in the lock 10, and excludes those key blades which have enlarged lands in the wrong places, the elongate opening 28A in the spacer need only have a configuration which is capable of accepting any key blade. That is to say, the width of the elongate spacer opening 28A at all locations, except where there are wards 28B, is great enough to accept a key blade 30 having an enlarged land, such as those numbered 36 and 39, at any land location.

Referring to FIG. 2, a capture or retention opening 30C in the blade 30 provides pin-receiving recesses on opposite sides of the blade, adjacent to and spaced from the blade distal end 30A, approximately midway between its side edges. The central blade grooves 46 and 49 on the opposite sides of the blade are aligned with the capture opening 30C.

For assembly purposes, described hereinafter, a handle-retaining or anchoring hole 30D is provided in the blade 30, adjacent to and spaced from the blade proximal end 30B. A plurality of kerfs 30E is formed on each edge of the blade 30 adjacent to its proximal end 30B. The kerfs 30E are defined by sawtooth-type anchor teeth 30F, which provide serrated edges at the proximal end 30B. An inner, rectangular extra one of the kerfs 30E is provided on one edge, for orienting the blade 30 by locating such kerf adjacent to the handle serrations 32B.

Referring to FIGS. 2–11, the key blade 30 is closely received within the key-receiving opening 18A of the facing plate 18, with the lands 36–43 received in the grooves 18C of the facing plate and the wards 18B of the facing plate received in the grooves 45–50 of the blade. The key blade 30 is received within the key-receiving opening 28A of the spacer 28, with the wards 28B of the spacer received in the outer two grooves 45, 47 and 48, 50 on opposite sides of the blade. The key blade is received in the diametral key-receiving slot 24F in the cylinder 24, and the distal blade end 30A is adapted for abutting engagement with the lock cylinder 24 at the base of the slot 24F. Thus, the distal blade end 30A bottoms in the slot 24F, as seen in FIGS. 10 and 11, to limit insertion of the key into the lock. When the key is thus inserted, the lands 36–43 and the grooves 45–50 extend longitudinally outwardly beyond the keyway 10A. The side portions of the tumblers 26 are received in the blade recesses 36B–39B and corresponding recesses on the opposite side of the blade, and abut on the bittings 36A–43A, as described above.

In use, the blade 30 of the key 12 is inserted into the lock keyway 10A, by manipulating the handle 32, until the distal end 30A of the blade bottoms in the cylinder slot 24F. During the insertion, the outer ends 26E of the tumblers 26 engage the bittings 36A–43A, as described above, whereby the tumblers are moved inwardly against the bias of the springs 52. Upon bottoming of the blade, the tumblers 26, particularly the deep grooves therein, such as the groove 26D, are so disposed as to enable the facing plate 18, the spacer 28, and the lock cylinder 24 to be rotated to an unlocking condition by turning the key 12. In this connection, it will be noted that the wards 18B of the facing plate 18, and the wards 28B of the spacer 28 are received in corresponding grooves 45–50 in the blade 30, the grooves extending outwardly beyond the keyway 10A, without limiting the insertion of the key by any engagement of a ward therewith.

As the blade 30 is inserted, the inner ends of the capture pins 34 on opposite sides of the blade are received in the central blade grooves 46 and 49, respectively, to permit insertion of the blade. When the blade 30 is fully inserted, the pins 34 are aligned with the capture opening 30C in the blade, which permits movement of the pins inwardly against the bias of their springs 35. When the key 12 is turned, the pins 34 are moved inwardly into the capture opening 30C by camming engagement of their outer ends with the barrel 14, as described in the above-identified application. In the absence of suitable recess means, such as provided by the capture opening 30C, the pins 34 would interlock with the barrel 14, to prevent rotation of the lock cylinder 24. After rotating the lock cylinder to an unlocking condition, and in the absence of any relief area in the wall of the barrel 14, the inner ends of the pins 34 remain within the capture opening 30C, to hold the key 12 captive in the lock 10, until the lock cylinder is restored to its locking condition.

The illustrative preferred combination of the key 12 and the lock 10 employs eight pin tumblers 26 and key bittings 36A–43A, which is one more than certain widely used "circular key" locks, thereby increasing the lock security and the number of key changes afforded. Alternatively, a lesser number of tumblers and bittings may be employed for either or both tumbler rows, especially where a smaller, more compact lock is desired. The preferred structure embodies at least one row of a minimum of three tumblers, and a double row structure such as illustrated is much preferred for exceptional security. While the tumblers in each row preferably face the corresponding tumblers in the other row, they may be disposed in other relationships, such as staggered, with the key lands, grooves and bittings cooperatively disposed on the key blade.

The key grooves 45–50 cooperate with the lock wards 18B and 28B in providing additional lock security and precision in operation, and the grooves also serve to space the lands 36–43 and their bittings 36A–43A apart from adjacent ones, so that there is no problem of the bittings engaging or "picking up" tumblers 26 adjacent to the proper ones, upon insertion of the key. Further, key duplication is made difficult by the need for the lands, grooves, and bittings, especially in their back-to-back relationship.

The provision in the lock of the capture pins 34 adds to the security and complicates picking and key duplication efforts, inasmuch as key blade grooves are required, as previously described, which will align with the pins and permit the blade 30 to be inserted into the lock. Then, the capture opening 30C must be provided in the correct position in the blade 30, to enable the lock cylinder to be rotated.

Figure 13:
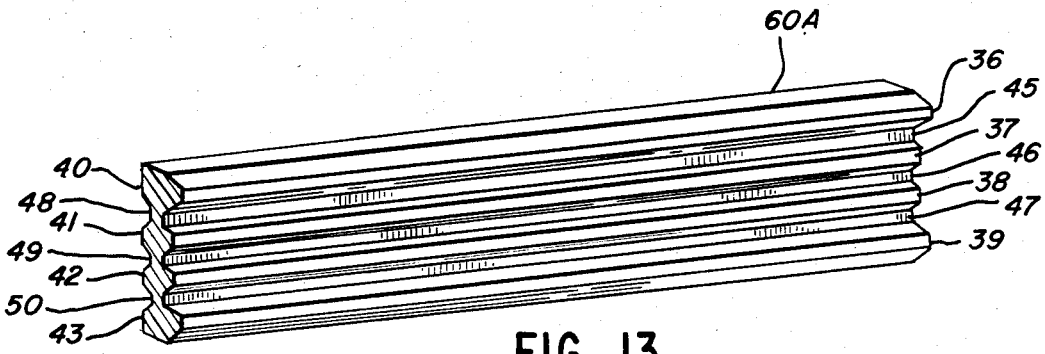
FIG. 13 is a perspective view of a portion of the same piece of stock after it has been rolled, to form lands and grooves thereon.

The prior art has recognized that it is more economical to manufacture a grooved key blade separately from the key handle, because the grooves for a number of individual key blades can be formed simultaneously along the length of a piece of bar stock, and a plurality of individual blades then can be made from the grooved bar stock. Similarly, in the present invention, the manufacture of key blades 30 begins with an elongated piece of metal bar stock 60 or the like, which is longer than any one blade, having a length sufficient to form a plurality of key blade blanks therefrom along the length thereof. The desired lands 36–43 and grooves 45–50 are formed on the sides of the bar stock, as seen in FIG. 13.

It is part of this invention, however, that the formation of the lands and grooves is done by a process of rolling, rather than by the procedures previously employed for making key blades, such as milling and extrusion. Rolled blade stock is much stronger than a structure formed by milling away sufficient metal to define the grooves, or one which is formed by passing the stock through an extrusion die of appropriate configuration to define the desired lands and grooves. The rolling procedure compresses and strengthens the metallic material of the bar 60 in the areas which are depressed to form the grooves 45–50. Such compressing and strengthening also occurs, although to a lesser extent, in those areas which are partially compressed to form the smaller lands 37, 38 and 40–43. Unlike the prior milling, no metal is removed, so that there is virtually no waste.

Figure 12:
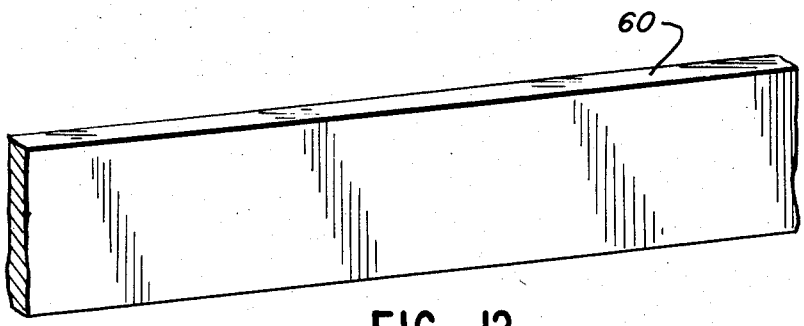
FIG. 12 is a perspective view of a portion of a piece of elongated flat blade stock which can be employed in manufacturing the blade of the key.

The rolling process may commence with bar stock of any suitable cross section. It is convenient to start with round bar stock, which first is rolled to a generally flat elongated bar or strip, such as the bar 60 of FIG. 12. Then, the lands and grooves are formed by rolling, to produce the rolled, contoured, generally flat bar 60A of FIG. 13, having the lands 36–43 and the grooves 45–50 formed therein.

Figure 5:
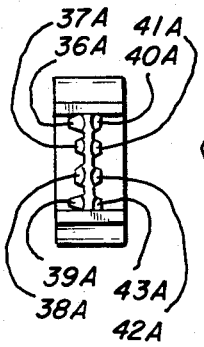
FIG. 5 is a front elevational view of the key.
Figure 14:
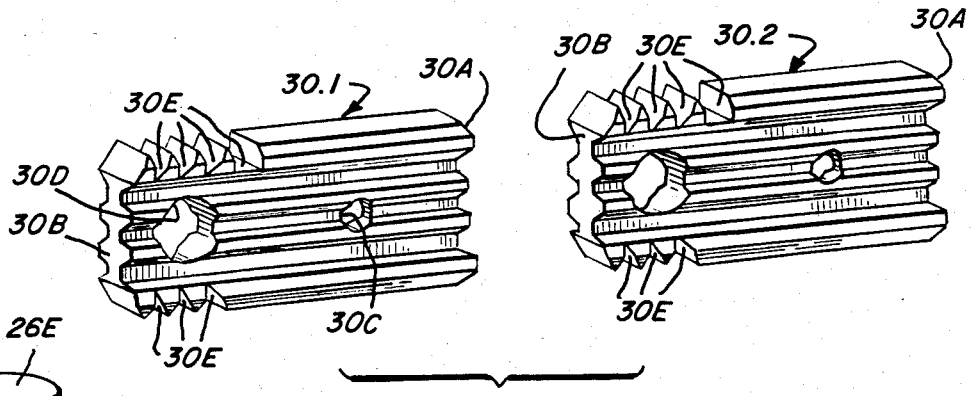
FIG. 14 is a perspective view of two individual key blade blanks cut from the rolled blade stock of FIG. 13 after stamping and/or punching the same.
Figure 15:
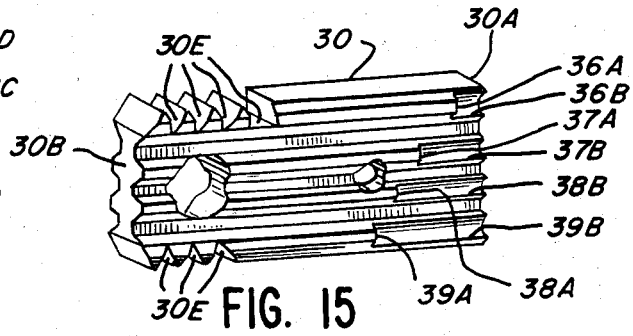
FIG. 15 is a perspective view of one of the blanks of FIG. 14 after forwardly-facing bittings have been formed on the lands thereof in accordance with this invention, to provide the key blade illustrated in earlier views.

Blade blanks such as those numbered 30.1 and 30.2 of FIG. 14 next are stamped or punched and cut from the contoured bar 60A. In one preferred procedure, the operations are performed by a progressive die, which punches the openings 30C and 30D, stamps out the kerfs 30E, and severs the blanks 30.1 and 30.2. Thereafter, the blanks are end-milled from the distal end 30A, to form the cylindrically rounded recesses 36B–39B in the lands 36–39 on one side, and similar recesses in the lands 40–43 on the opposite side. The transverse flat arcuate bittings 36A–43A are provided thereby, at the rear or inner ends of the recesses, as illustrated in FIGS. 5 and 15.

The kerfs 30E, cut to form serrated opposite edges adjacent to the proximal end 30B of the blade, and the handle retaining hole 30D permit the fastening of the handle 32 to the blade 30 by a novel, convenient, and economical method. The handle 32 is formed of a conventional thermoplastic material which softens under suitable heating. The depth of the pocket 32A in the handle is such that when the proximal end 30B of the blade is inserted thereinto, both the retaining hole 30D and the kerfs are received completely within the pocket. Then, the assembly of the handle and the blade preferably is subjected to ultrasonic wave energy, which is externally directed to the handle and the proximal blade end therein. As a result, the plastic material of the handle 32 is heated to its softening point adjacent to the blade end, and then flows into the kerfs 32E and the hole 32D, in intimate, securing engagement with the blade end. The thermoplastic material is allowed to cool and harden whereupon the handle 32 and the key blade 30 form an interpenetrating and therefore permanent assembly.

While preferred embodiments of the invention have been illustrated and described, it will be apparent to those skilled in the art that various changes and modifications may be made therein, within the spirit and scope of the invention. It is intended that such changes and modifications be included within the scope of the appended claims.

I claim:

1. In combination with a cylinder lock having: a longitudinally extending diametral keyway terminating at an inner end in a key abutment which determines the depth of insertion of a key into the lock, for operating the lock; a planar transverse row of at least three tumblers longitudinally reciprocatable in the lock with a side portion of each tumbler projecting into the keyway and an outer end of such portion accessible for engagement with the key; and at least one ward projected transversely into said keyway between the longitudinal axes of a pair of adjacent tumblers; an improved key comprising:

a substantially flat one-piece integral blade insertable in said keyway and having a distal end abutting on said key abutment and a proximal end extending longitudinally outwardly beyond said keyway when the key is fully inserted into the keyway.

said blade having a longitudinal rolled land on one side of the blade for each of said tumblers, and a rolled groove extending longitudinally in the blade between each pair of adjacent lands, said lands and said grooves extending from said distal end to said proximal end, said ward being received in one of said grooves for insertion of the key into the lock unlimited by any engagement of a ward with the key, Said blade including a bitting for each of said tumblers and each bitting comprising a transverse shoulder on one of said lands disposed at the inner end of a recess extending longitudinally in the land for a predetermined distance from said distal end of the blade corresponding to the tumbler code, said recess receiving said side portion of a tumbler therein for abutting engagement of the bitting with said outer end of the side portion.

2. A combination as defined in claim 1 wherein said lock also includes a key-capture pin having an inner end that extends into said keyway, said blade is provided with a key-capture pin-receiving recess therein, and one of said grooves in said blade is aligned with the latter recess for receiving said pin end in the groove upon insertion of the key into the lock.

3. A combination as defined in claim 1 wherein a portion of said keyway has a land-and-groove configuration on one side thereof adjacent to said tumblers, including at least one groove projecting laterally outwardly of the keyway for a greater distance than at least one other groove on the same side of the keyway, and said blade has a land-and-groove profile that is complementary to said configuration.

4. In combination with a cylinder lock having: a longitudinally extending diametral keyway terminating at an inner end in a key abutment which determines the depth of insertion of a key into the lock, for operating the lock; two parallel planar transverse rows of at least three tumblers longitudinally reciprocatable in the lock, said rows being disposed on opposite sides of said keyway and each tumbler having a side portion projecting into the keyway and an outer end of such portion accessible for engagement with the key; and a ward projecting transversely into said keyway substantially midway between the longitudinal axes of each pair of adjacent tumblers in each of said rows; an improved key comprising:

a substantially flat one-piece integral blade insertable in said keyway and having a distal end abutting on said key abutment and a proximal end extending longitudinally outwardly beyond said keyway when the key is fully inserted into the keyway.

said blade having a longitudinal rolled land on one side of the blade for each of said tumblers in one row and a longitudinal rolled land on the opposite side of the blade for each of said tumblers in the remaining row, and a rolled groove extending longitudinally in the blade between each pair of adjacent lands on each side of the blade, said lands and said grooves extending from said distal end to said proximal end, said wards being received in respective ones of said grooves for insertion of the key into the lock unlimited by any engagement of a ward with the key, said blade including a bitting for each of said tumblers and each bitting comprising a transverse shoulder on one of said lands disposed at the inner end of a recess extending longitudinally in the land for a predetermined distance from said distal end of the blade corresponding to the tumbler code, said recess receiving said side portion of a tumbler therein for abutting engagement of the bitting with said outer end of the side portion.

5. A combination as defined in claim 4 wherein said tumblers in each row face respective tumblers in the other row, and said lands and grooves on each side of said blade are disposed in back-to-back relation to respective lands and grooves on the opposite side of the blade.

6. A combination as defined in claim 4 wherein a portion of said keyway has a land-and-groove configuration on one side thereof including at least one groove projecting laterally outwardly of the keyway for a greater distance than at least one other groove on the same side of the keyway, and said blade has a land-and-groove profile that is complementary to said configuration.

7. A combination as defined in claim 6 wherein said lock also includes a key-capture pin having an inner end that extends into said keyway, said blade is provided with a key-capture pin-receiving recess therein, and one of said grooves in said blade is aligned with the latter recess for receiving said pin end in the groove upon insertion of the key into the lock.

* * * * *

UNITED STATES PATENT AND TRADEMARK OFFICE

CERTIFICATE OF CORRECTION

PATENT NO. : 4,735,069

DATED : April 5, 1988

INVENTOR(S) : Robert L. Steinbach

It is certified that error appears in the above-identified patent and that said Letters Patent are hereby corrected as shown below:

Column 1, line 7, change "13" to --23--.

Column 1, lines 15 and 16, cancel the sentence "More .... thereof." and substitute:

--More particularly, the invention relates to grooved keys for use with such locks having coplanar tumblers, such as disclosed in my above-referenced patent application. --.

Column 1, line 33, before "3,813,906" insert -- U.S. Patents --.

Signed and Sealed this

Fourth Day of October, 1988

*Attest:*

*Attesting Officer*

DONALD J. QUIGG

*Commissioner of Patents and Trademarks*